US010808380B2

(12) United States Patent
Harr et al.

(10) Patent No.: US 10,808,380 B2
(45) Date of Patent: Oct. 20, 2020

(54) ROTATOR ARRANGEMENT WITH AN ANGLE METER

(71) Applicant: Indexator Rotator Systems AB, Vindeln (SE)

(72) Inventors: Joakim Harr, Vindeln (SE); Magnus Lindgren, Umeå (SE); Niklas Vännman, Umeå (SE)

(73) Assignee: Indexator Rotator Systems AB, Vindeln (SE)

( * ) Notice: Subject to any disclaimer, the term of this patent is extended or adjusted under 35 U.S.C. 154(b) by 0 days.

(21) Appl. No.: 16/486,199

(22) PCT Filed: Mar. 5, 2018

(86) PCT No.: PCT/EP2018/055371
§ 371 (c)(1),
(2) Date: Aug. 15, 2019

(87) PCT Pub. No.: WO2018/162424
PCT Pub. Date: Sep. 13, 2018

(65) Prior Publication Data

US 2020/0002917 A1 Jan. 2, 2020

(30) Foreign Application Priority Data

Mar. 6, 2017 (SE) ..... 1750246

(51) Int. Cl.

| | |
|---|---|
| ***E02F 9/00*** | (2006.01) |
| ***B66C 13/46*** | (2006.01) |
| ***B66C 23/62*** | (2006.01) |
| ***E02F 9/22*** | (2006.01) |
| ***E02F 9/26*** | (2006.01) |
| ***F04D 29/00*** | (2006.01) |

(52) U.S. Cl.
CPC ..... *E02F 9/006* (2013.01); *B66C 13/46* (2013.01); *B66C 23/62* (2013.01); *E02F 9/2275* (2013.01); *E02F 9/264* (2013.01); *F04D 29/00* (2013.01)

(58) Field of Classification Search
CPC ..... B66C 1/00; E02F 1/00
See application file for complete search history.

(56) References Cited

U.S. PATENT DOCUMENTS

2005/0105240 A1* 5/2005 Jonsson ..... E02F 3/3681 361/160

FOREIGN PATENT DOCUMENTS

WO WO 2016/099372 A1 6/2016

* cited by examiner

*Primary Examiner* — Shirley Lu
(74) *Attorney, Agent, or Firm* — Blank Rome LLP

(57) ABSTRACT

A rotator arrangement (10) comprising a motor (11) with a stator (13) and a rotor (12) arranged inside the stator (13) to rotate with respect to said stator (13) around an axial axis (A). The rotator arrangement (10) comprises a rotor attachment piece (15) connected to the rotor and a stator attachment piece (16) connected to the stator, wherein one of the rotor attachment piece (15) and stator attachment piece (16) is arranged to be attached to a crane arm or the like, and the other is arranged to be attached to a tool implement. An angle meter (17) is arranged to continuously monitor the rotation of the rotor (12) with respect to the stator (13), wherein the angle meter (17) comprises a stator part (18) that is arranged to rotate with the stator (13) a rotor part (19) that is arranged to rotate with the rotor (14), and wherein the angle meter (17) is arranged along the axial axis (A).

10 Claims, 4 Drawing Sheets

ROTATOR ARRANGEMENT WITH AN ANGLE METER

TECHNICAL FIELD

The invention relates to a rotator arrangement for providing a rotating movement, the rotator arrangement comprising a motor with a stator and a rotor arranged inside the stator. Specifically, the invention relates to such a rotator arrangement with an angle meter.

BACKGROUND

Rotator arrangements are widely used in foresting, harvesting or the like where a carrier, truck, tractor or the like carries an arrangement for handling excavators, timber tools, harvest tools or the like. Often such arrangements are hydraulically driven and include a crane arm, wherein the rotator arrangement is arranged to the free end of the arm. The rotator arrangement typically includes a motor, i.e. a hydraulic motor, to provide rotational movement.

Such rotator arrangements are exposed to heavy forces both radially and axially. Conventionally, these heavy forces are handled by dimensioning the rotator arrangement and specifically the motor with components adapted to withstand very high efforts. In combination to this high mechanical demands the precision of the components, including the fit between the stator and rotor needs to be very accurate and precise. Further, to meet the demands of the users, rotator arrangements of today are provided with more and more precision demanding electronics, such as positioning devices and the like.

A problem involved with the arrangement of sensitive apparels in the harsh environment of a rotator arrangement, is both to arrange them in a manner such that they are not exposed to high mechanical efforts and such that they may be accessed to be serviced, updated or exchanged when needed.

Hence there is a need of an arrangement that facilitates installation of sensitive apparels such as an angle meter and that provides a reliable metering over time.

SUMMARY OF THE INVENTION

It is an object of the present invention to provide a rotator arrangement in which an angle meter is provided in a manner that facilitates installation thereof and that provides a possibility of service and/or upgrading of the angle meter.

The invention relates to a rotator arrangement for providing a rotating movement, the rotator arrangement comprising a motor with a stator and a rotor arranged inside the stator to rotate with respect to said stator around an axial axis, wherein the rotator arrangement comprises a rotor attachment piece connected to the rotor and a stator attachment piece connected to the stator, wherein one of the rotor attachment piece and stator attachment piece is arranged to be attached to a crane arm or the like, and the other is arranged to be attached to a tool implement, characterised in that an angle meter is arranged to monitor the rotation of the rotor with respect to the stator, wherein the angle meter comprises a stator part that is connected to the stator and a rotor part that is arranged to rotate with the rotor, wherein the rotor part is arranged centrally along the axial axis.

In a specific embodiment the rotor part and the stator part of the angle meter are arranged as separate parts at least partially inside the rotator arrangement, the sensor of the stator part being arranged with a gap with respect to the angle indicator of the rotor part.

In a specific embodiment the stator part of the angle meter is arranged to extend into a through hole through the stator to the rotor.

In a specific embodiment a part of the stator part of the angle meter that extend into the through hole through the stator has a width that is smaller than the width of said through hole, such that the stator part of the angle meter may be accessed from outside of the stator without dismounting the rotator arrangement.

In a specific embodiment the angle meter is configured to provide an absolute angular position of the rotor with respect to the stator, the sensor being configured to monitor an absolute angular position of the angle indicator.

In a specific embodiment the rotator arrangement comprises a swivel for urea including a urea conduit running centrally through the rotor along the axial axis thereof and extending outside of the rotor, the angle indicator being provided in connection to the portion of the urea conduit that extends outside of the rotor.

In a specific embodiment the rotator arrangement comprises an electric swivel, the angle indicator being connected to a rotor part of said electric swivel.

In a specific embodiment the rotator arrangement comprises a hydraulic swivel, the angle indicator being connected to a rotor part of said hydraulic swivel.

In a specific embodiment the sensor is arranged axially aligned to the angle indicator along the axial axis.

In another specific embodiment the sensor is arranged radially outside the angle indicator.

Other embodiments and advantages will be apparent from the detailed description and the appended drawings.

BRIEF DESCRIPTION OF DRAWINGS

An exemplary embodiment related to the invention will now be described with reference to the appended drawings, of which.

DETAILED DESCRIPTION OF EMBODIMENTS

Figure 1:
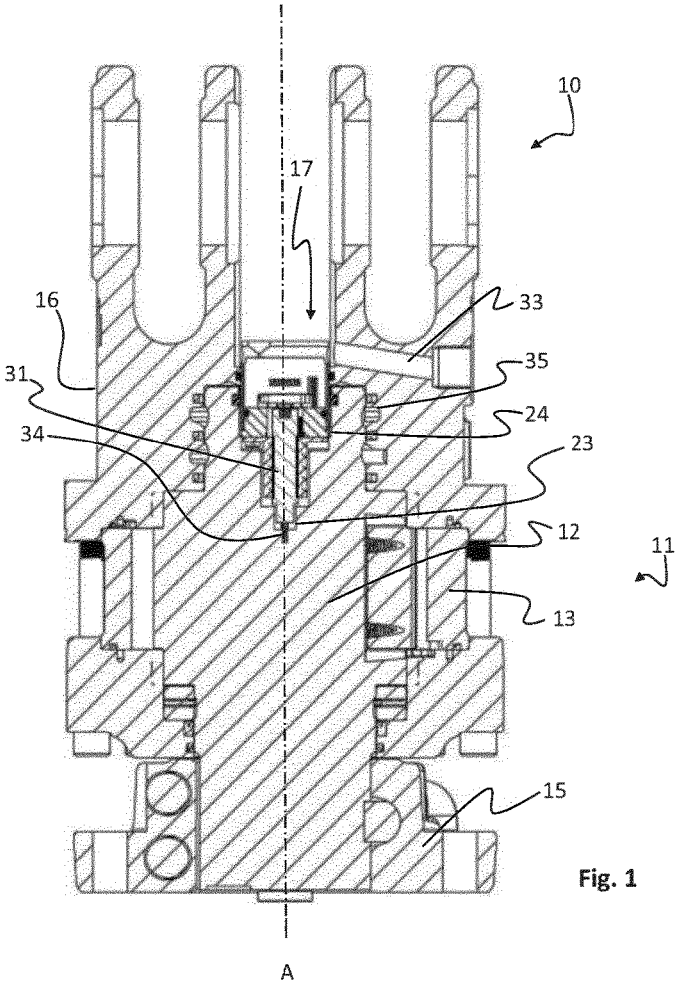
FIG. 1 is a sectional view of a rotator arrangement according to a first embodiment of the invention.

In the figures below similar features of different embodiments of the inventive rotator arrangement have been given the same reference numerals even though there may be minor differences between the specific features of the different embodiments.

In FIG. 1 a rotator arrangement 10 of a first embodiment of the invention is shown in a sectional view. The rotator arrangement 10 is arranged to provide a rotating movement and comprises a motor 11 with a rotor 12 and a stator 13, wherein the rotor 12 is arranged inside the stator 13 to rotate with respect to said stator 13 around an axial axis A. The rotator arrangement 10 comprises a rotor attachment piece 15 connected to the rotor 12 and a stator attachment piece 16 connected to the stator 13, wherein one of the rotor attachment piece 15 and stator attachment piece 16 is arranged to be attached to a crane arm or the like, and the other is arranged to be attached to a tool implement. In the shown first embodiment the stator attachment piece 16 is adapted to be arranged to a crane arm, typically a hydraulic pivot arm or the like. The rotor attachment piece 15 of the shown first embodiment is hence arranged to be attached to a tool implement, typically a hydraulically manoeuvrable tool implement such as a grip arm, bucket, harvesting tool or the like.

An angle meter 17 is arranged to continuously monitor the rotation of the rotor 12 with respect to the stator 13. The angle meter is arranged as a module and comprises a stator part 18 that is arranged to rotate with the stator 13 a rotor part 19 that is arranged to rotate with the rotor 12. The stator part 18 of the angle meter 17 comprises a first connective portion 21 arranged to connect to the stator 13, and the rotor part 19 of the angle meter 17 comprises a second connective portion 22 arranged to connect to the rotor 12. In the shown first embodiment the first connective portion 21 is comprised of a set of screw seats and screws arranged to be fastened in screw holes in the stator 13 of the motor 11.

The angle meter 17 is arranged along the axial axis A around which the rotor 12 is arranged to rotate with respect to the stator 13. The rotor part 19 of the angle meter 17 is connected to a central portion of the rotor 12. Typically, the second connective portion 22 of the rotor part is adapted to the design of the rotor to which it is arranged to connect. In the shown first embodiment, the rotor 12 includes a recess 23 into which part of the second portion of the angle meter 17 may be received. The second connective portion 22 may be provided with a rubber detail arranged to interact with the inside of the recess 23 in the rotor so as to be urged to rotate with the rotor 12. It may also be connected to the rotation of the rotor 12 via an electric connection 34 to a cable providing the tool attached to the rotor attachment part with electricity. A rotating body 31 of the rotor part 19 of the angle meter 17 is arranged to rotate with very low friction with respect to the stator part 18 of the angle meter 17.

The angle meter 17 is arranged in a through hole 24 extending through the stator 13 to the rotor 12 such that the angle meter may be accessed from outside of the stator 13. Further, the angle meter 17 has a width that is smaller than the width of the through hole 24 through the stator 13. Thereby the angle meter 17 may be both accessed and removed or replaced from its position without needing to dismount the rotator arrangement.

A conduct line 33 is arranged in the stator attachment for provision of electric lines to the angle meter 17.

Figure 3:
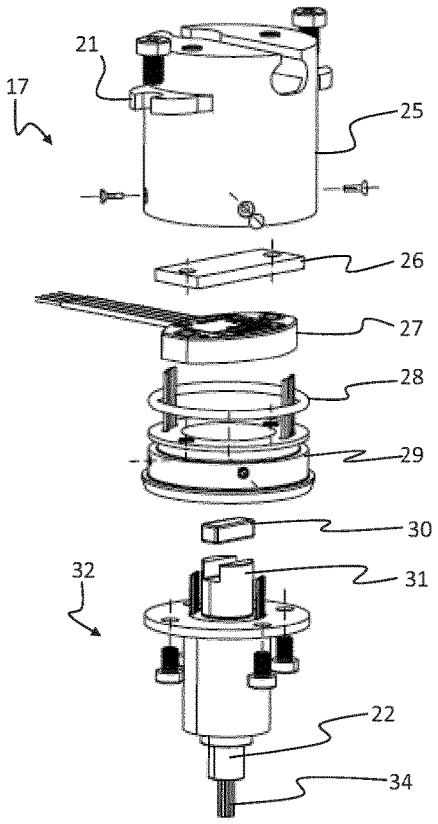
FIG. 3 is an exploded view of an angle meter of the first embodiment of the invention.
Figure 2:
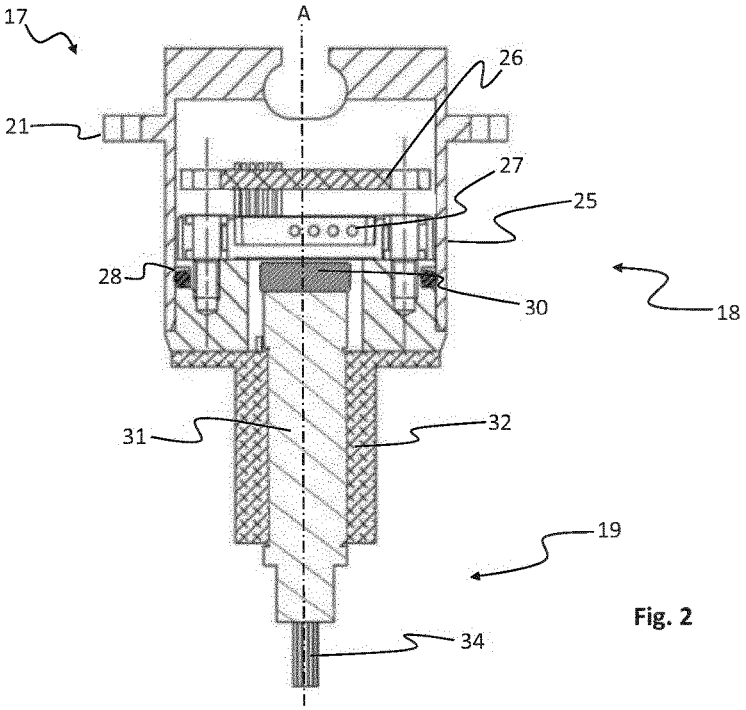
FIG. 2 is a sectional view of an angle meter of the first embodiment of the invention.

In FIGS. 2 and 3 the angle meter 17 in accordance with the first embodiment is shown in detailed in a sectional view and an exploded view, respectively.

The stator part 18 of the angle meter 17 comprises a casing 25 arranged to protect the electronic devices inside the angle meter. Inside said casing a processor unit 26 is arranged, which may be programmable and include analogue/digital converter for converting an analogue signal from an sensor 27 to a digital signal. Further, the angle meter 17 comprises a sealing 28 and a holder 29. Additional sealings may be arranged to seal the space between the angle meter and the rotor and/or the stator.

The rotor part 19 of the angle meter 17 comprises an angle indicator 30, typically in the shape of a magnet, arranged on a rotating body 31. The sensor 27 of the stator part 18 is arranged to sense the position of the angle indicator 30 and to, based on the sensed position, continuously monitor the angular position of the rotor 12 with respect to the stator 13. The angle indicator may have a cylindrical shape, a polygonal shape or it may be ring-shaped. The sensor 27 may as in the figures be arranged axially aligned to the angle indicator 30 or radially outside the angle indicator.

An advantage of the inventive angle meter 17 is that it may be easily serviced and/or upgraded. The size of the casing 25 of the stator part 18 of the angle meter 17 is preferably adapted to house additional sensors or the like, such as e.g. a gyro, a GPS-transmitter, a temperature sensor etc. In this respect it is advantageous both that the angle meter is arranged such that it may be readily accessible from outside of the rotator, and that the shape of the angle meter is adapted to house further sensible electronic devices.

In this specific first embodiment, the rotating body 31 further comprises an electric swivel 32 providing an electric connection through the rotor 12 to the tool arranged to the rotor attachment piece 15 on the opposite side of the rotor. An electric connection 34 is provided in the innermost part of the angle meter 17, including electric cables and control lines for providing the tool with electric power and a signalling connection. The cables and lines are connected via electric cables (not shown) to the tool attached to the rotor attachment part 15.

Figure 4:
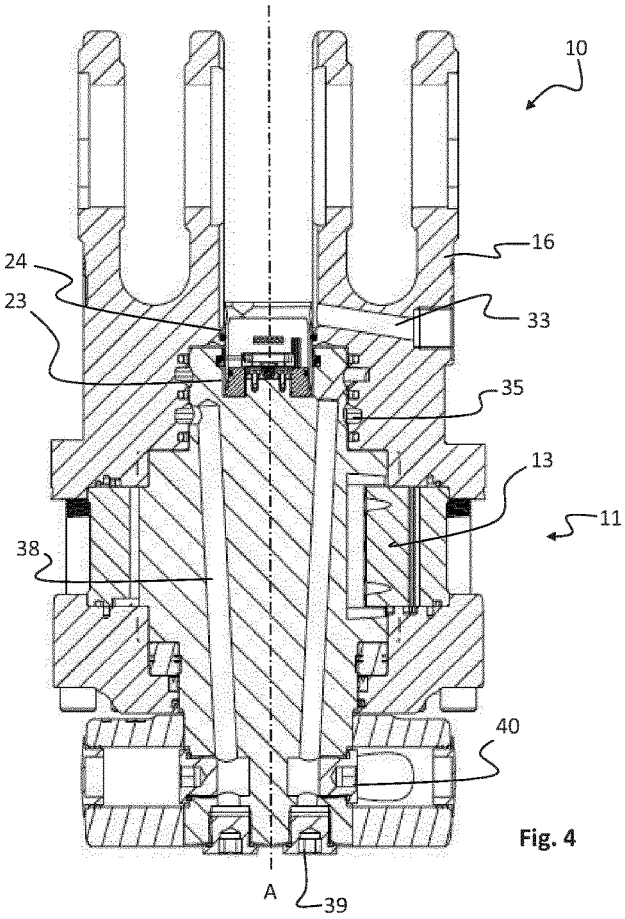
FIG. 4 is a sectional view of a rotator arrangement according to a second embodiment of the invention.
Figure 6:
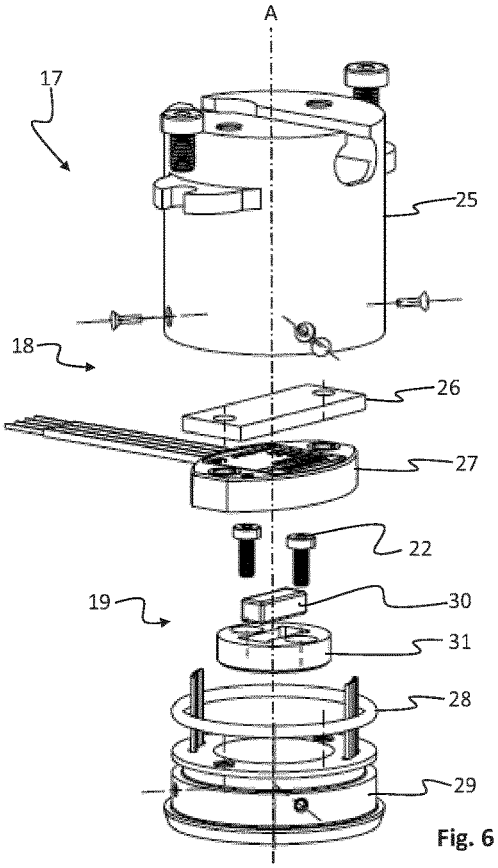
FIG. 6 is an exploded view of an angle meter of the second embodiment of the invention.
Figure 5:
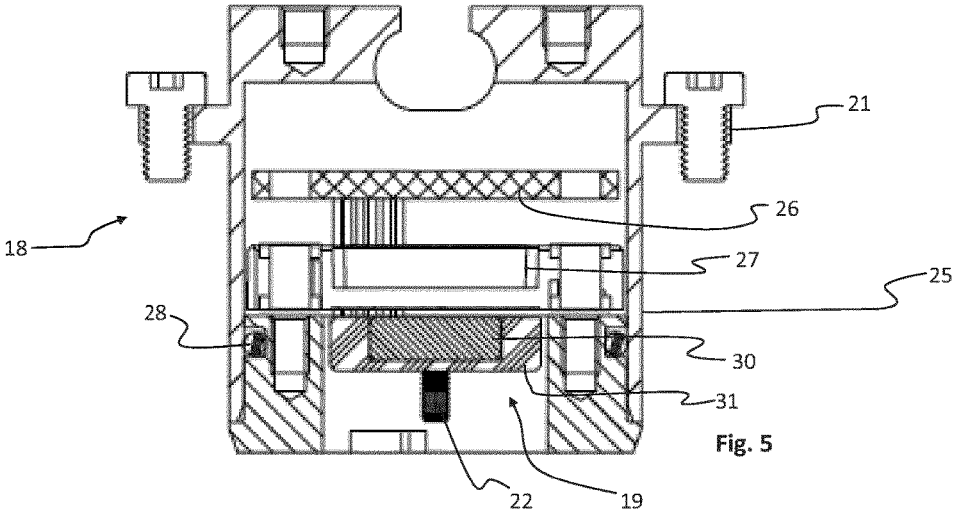
FIG. 5 is a sectional view of an angle meter of the second embodiment of the invention.

A rotator arrangement 10 according to a second embodiment is shown in FIG. 4. A main difference of this embodiment with respect to the first embodiment shown in FIGS. 1-3 is that the angle meter 17 does not include an electric swivel. Further, the rotor 12 does not include a recess to receive a rotating part of the rotor part of the angle meter. Instead, the rotor part 19 of the angle meter is mainly comprised of a holder portion for holding the angle indicator 30 and a second connective portion 22 which is to be connected to a flat portion of the rotor 12. The rotor part 19 of the angle meter 17 may be comprised of merely an angle indicator 30, wherein the second connective portion 22 is comprised of an adhesive connecting the angle indicator 30 to the rotation of the rotor 12.

Hydraulic conduits 38 are arranged through the rotor 12 for connection to the tool attached to the rotor attachment piece 15, via axial connections 39 or radial connections 40.

Figure 7:
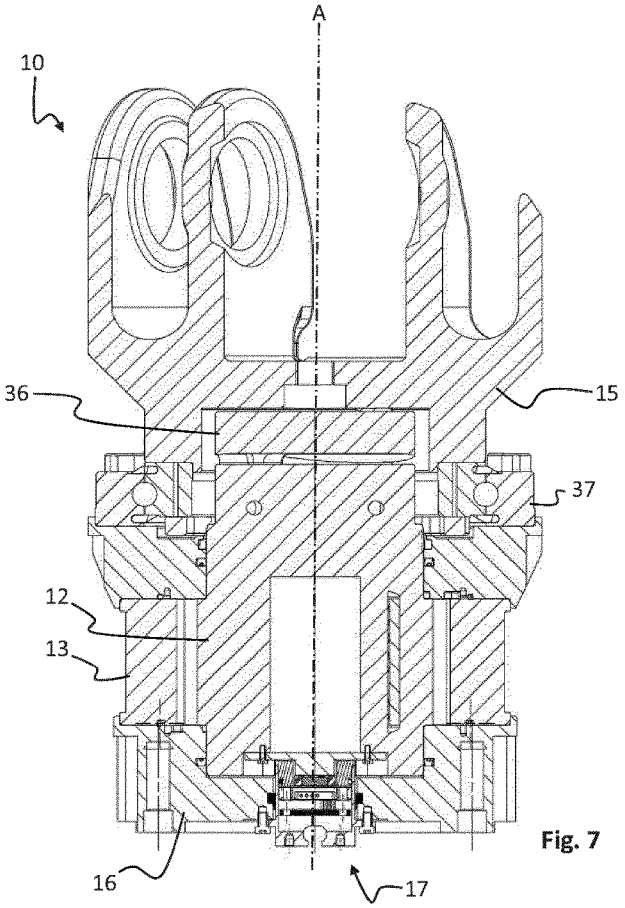
FIG. 7 is a sectional view of a rotator arrangement according to a third embodiment of the invention.
Figure 9:
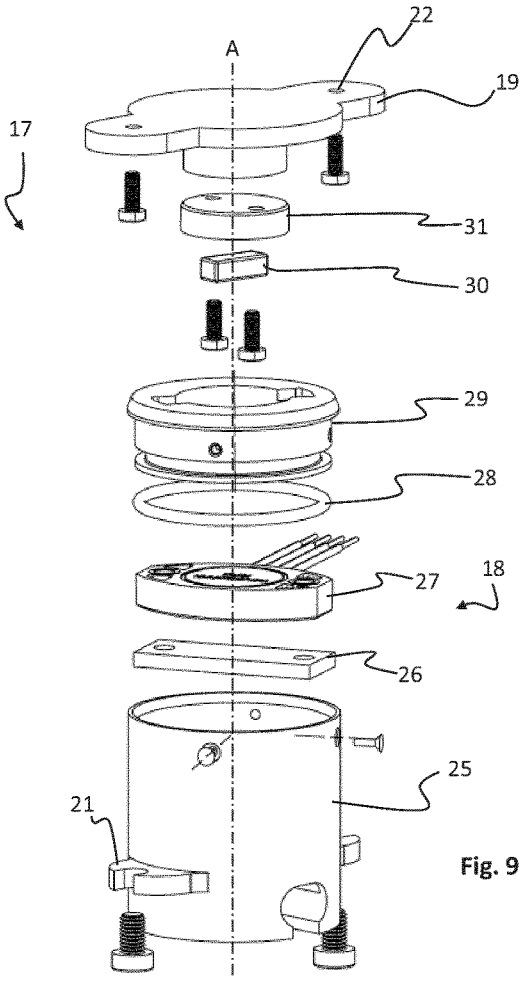
FIG. 9 is an exploded view of an angle meter of the third embodiment of the invention.
Figure 8:
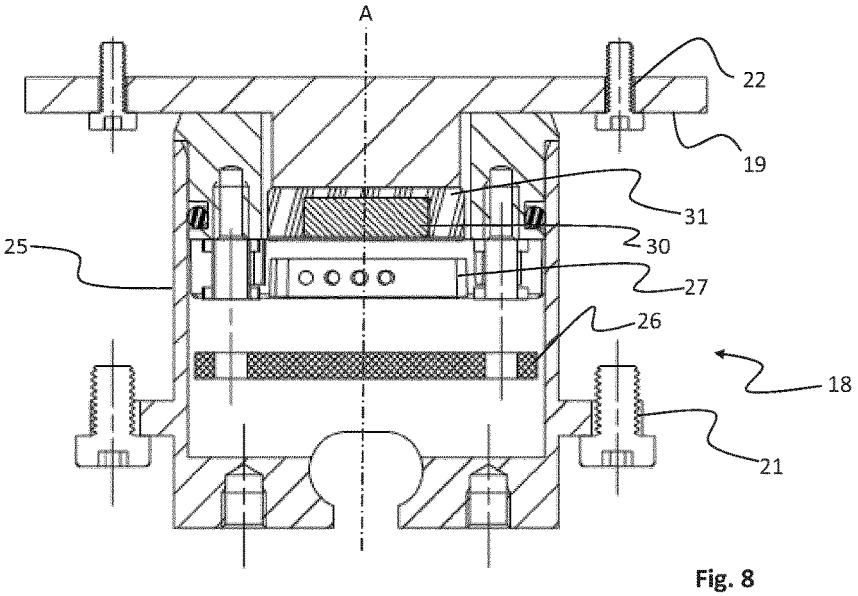
FIG. 8 is a sectional view of an angle meter of the third embodiment of the invention.

In FIG. 7 a rotator arrangement 10 according to a third embodiment is shown. In this embodiment the rotor attachment piece 15 is arranged to be connected to a crane arm or the like, and the stator attachment piece 16 is arranged to be attached to a tool implement. The rotor attachment piece 15 is connected to the rotor 12 via an intermediate torque element for transmitting the torque therebetween. Axial forces are arranged to be handled by the stator without acting on the rotor 12. This is an advantage as it allows the angle meter to be arranged in a position where it is not exposed to any forces that may influence the angle metering.

In this third embodiment the rotor part 19 of the angle meter 17 is adapted to be attached to a rotor 12 with a central recess, without extending into said recess. Instead, the rotor part 19 of the angle meter 17 is provided with a radially extending portion with a second connective portion 22 in the form of screw holes for receiving screws that are to be screwed into the rotor 12. A rotating body is arranged as an integrated part of the rotor part 19 of the angle meter 17, or as part connected thereto, and is arranged to hold an angle indicator 30.

The stator part 18 of the angle meter 17 is arranged to partially enclose the rotor part 19 with the sensor 27 arranged axially aligned to the angle indicator 30 with a small gap formed between the sensor 27 and the angle indicator 30.

Figure 11:
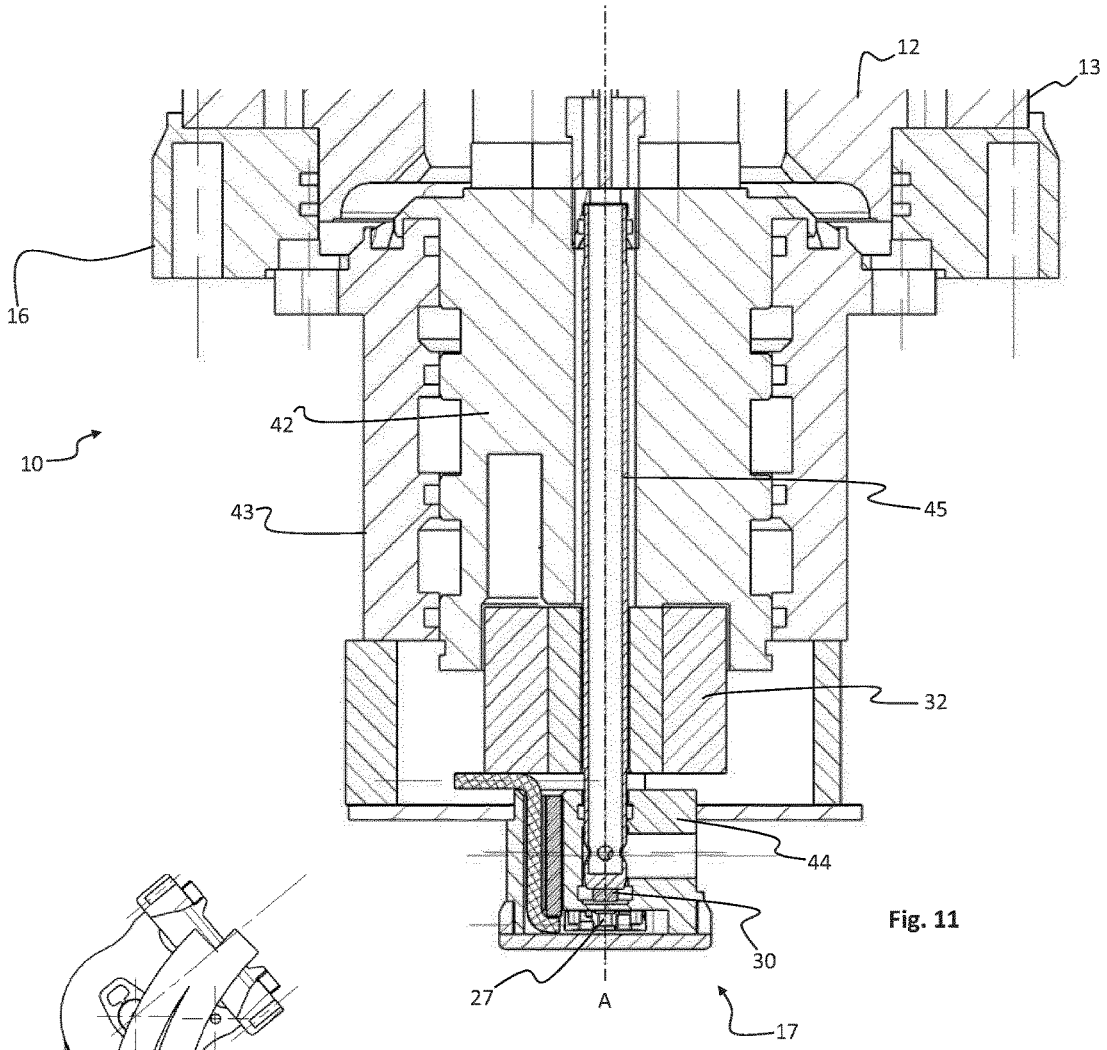
FIG. 11 is a detailed view of the rotator arrangement in FIG. 10.
Figure 10:
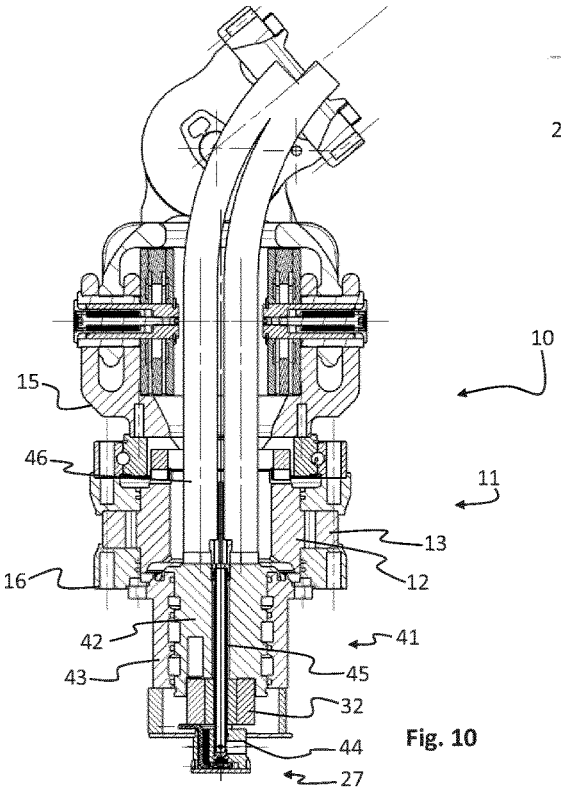
FIG. 10 is a sectional view of a rotator arrangement according to a fourth embodiment of the invention.

In FIGS. 10 and 11 a fourth embodiment of the inventive rotator arrangement 10 is shown. In this embodiment, the motor 11 comprises a hollow rotor 12 arranged inside a stator 13. The rotor attachment part 15 is arranged to be attached to a crane arm, typically a hydraulic pivot arm or the like, and the stator attachment part 16 is arranged to be attached to a tool implement. Hydraulic conduits 46, electric cables and possibly conduits for urea are arranged to pass through the hollow rotor 12 to the rotor part 42 of a hydraulic swivel 41. In the shown embodiment a fluid conduit 45 for urea is arranged along the central axis A of the motor 11.

The rotor part 19 of the angle meter 17 is arranged to rotate with the rotor 12, but only via an auxiliary device. For example, an angle indicator 30, typically on the form of a magnet, may be connected to an end portion of a fluid conduit 45 running centrally through the rotor along the axial axis A thereof and extending outside of the rotor 12. In the shown embodiment the fluid conduit 45 is part of a urea swivel 44. The angle indicator 30 may be provided in connection to the portion of the fluid conduit 45 that extends outside of the rotor 12, wherein the stator part 18 of the angle meter 17 is arranged with the sensor 27 arranged axially aligned to the angle indicator 30, or radially outside the angle indicator, with a small gap formed between the sensor 27 and the angle indicator 30. The stator part 18 may be arranged to partially enclose the rotor part 19 and the angle indicator.

In the shown embodiment the rotator arrangement comprises a hydraulic swivel, an electric swivel 32, and a urea swivel 44 which are all arranged in the axial extension of the hydraulic motor 11. The fluid conduit 45 is arranged to pass through the centre of all of the three swivels. In another possible not shown embodiment of the inventive rotator arrangement the urea swivel may be disposed with, such that the angle meter may be integrated with the electric swivel, the angle indicator being arranged on the rotor part of the electric swivel.

Above, the invention has been described with reference to specific embodiments. The invention is however not limited to these embodiments. It is obvious to a person skilled in the art that other embodiments are possible within the scope of the following claims.

The invention claimed is:

1. A rotator arrangement for providing a rotating movement, the rotator arrangement comprising a motor with a stator and a rotor arranged inside the stator to rotate with respect to said stator around an axial axis, wherein the rotator arrangement comprises a rotor attachment piece connected to the rotor and a stator attachment piece connected to the stator, wherein one of the rotor attachment piece and stator attachment piece is configured to be attached to a crane arm, and the other is configured to be attached to a tool implement, wherein an angle meter is configured to monitor the rotation of the rotor with respect to the stator, wherein the angle meter comprises a rotor part with an angle indicator that is configured to rotate with the rotor, and a stator part with a sensor configured to monitor the angular position of said angle indicator, which stator part is connected to the stator, and wherein the rotor part is arranged centrally along the axial axis.

2. A rotator arrangement according to claim 1, wherein the rotor part and the stator part of the angle meter are arranged as separate parts at least partially inside the rotator arrangement, the sensor of the stator part being arranged with a gap with respect to the angle indicator of the rotor part.

3. A rotator arrangement according to claim 1, wherein the stator part of the angle meter is arranged to extend into a through hole through the stator to the rotor.

4. A rotator arrangement according to claim 3, wherein a part of the stator part of the angle meter that extend into the through hole through the stator has a width that is smaller than the width of said through hole, such that the stator part of the angle meter may be accessed from outside of the stator without dismounting the rotator arrangement.

5. A rotator arrangement according to claim 1, wherein the angle meter is configured to provide an absolute angular position of the rotor with respect to the stator, the sensor being configured to monitor an absolute angular position of the angle indicator.

6. A rotator arrangement according to claim 1, wherein the rotator arrangement comprises a swivel for urea including a urea conduit running centrally through the rotor along the axial axis thereof and extending outside of the rotor, the angle indicator being provided in connection to the portion of the urea conduit that extends outside of the rotor.

7. A rotator arrangement according to claim 1, wherein the rotator arrangement comprises an electric swivel, the angle indicator being connected to a rotor part of said electric swivel.

8. A rotator arrangement according to claim 1, wherein the rotator arrangement comprises a hydraulic swivel, the angle indicator being connected to a rotor part of said hydraulic swivel.

9. A rotator arrangement according to claim 1, wherein the sensor is arranged axially aligned to the angle indicator along the axial axis.

10. A rotator arrangement according to claim 1, wherein the sensor is arranged radially outside the angle indicator.

* * * * *